United States Patent [19]

Gmelch

[11] 4,297,050

[45] Oct. 27, 1981

[54] HIGHWAY GUIDE POST

[76] Inventor: John C. Gmelch, 242 Pleasant St., Wakefield, Mass. 01880

[21] Appl. No.: 66,807

[22] Filed: Aug. 15, 1979

[51] Int. Cl.[3] ..... E01F 9/00

[52] U.S. Cl. ..... 404/10; 256/13.1; 40/608

[58] Field of Search ..... 404/10; 256/1, 13.1; 40/606, 607, 608

[56] References Cited

U.S. PATENT DOCUMENTS

| | | | |
|---|---|---|---|
| 3,502,007 | 3/1970 | Andersson | 404/10 |
| 3,709,112 | 1/1973 | Ebinger | 404/10 |
| 4,032,248 | 6/1977 | Parduhn | 404/10 |
| 4,061,435 | 12/1977 | Schmanski | 404/10 |
| 4,078,867 | 3/1978 | Ronden | 404/10 |
| 4,088,415 | 5/1978 | Syak | 404/10 X |
| 4,092,081 | 5/1978 | Schmanski | 404/10 |
| 4,123,183 | 10/1978 | Ryan | 404/10 |

FOREIGN PATENT DOCUMENTS

| | | | |
|---|---|---|---|
| 387681 | 5/1965 | Switzerland | 404/10 |

*Primary Examiner*—Nile C. Byers, Jr.
*Attorney, Agent, or Firm*—Llewellyn A. Proctor

[57] ABSTRACT

A post, or picket, for vertically positioning within the soil for delineation of a section of highway which on vehicular impact is capable of bending in any direction and thereafter, when the vehicle has passed, rebounding to its original position. The body of the post is constituted of a hollow, tubular thermoplastic rubber body, trapezoidal in cross-section throughout its length; and its surface characteristics are such that the surface of the post can be readily colored with highway safety colors, e.g. white, yellow, etc. The post is mounted and retained within the soil via use of a rigid foot member which can be attached to the lower portion thereof, the lower position of the foot member being tapered and provided with sharp, serrated edges for cutting into the soil within which the post is to be erected.

10 Claims, 6 Drawing Figures

HIGHWAY GUIDE POST

The introduction and use of the automobile by our society during this century continues in numbers which outpaces the skill of drivers and the capacity of the streets and highways to accommodate such traffic. Numerous accidental collisions between vehicles and with off the highway objects continue to produce bodily injuries and deaths. These statistics are, for example, reflected by automobile insurance premiums which have grown from an insignificant figure at the beginning of the century to a level representative among the largest of the costs of owning and operating such vehicles. Measured by premium volume automobile insurance is by far the largest single segment of all property and liability insurance business; being almost as large, and perhaps larger than all other lines of insurance combined.

Structures for marking areas, signaling and conveying information to drivers, guide posts and pickets for marking off and designating traffic lanes are obviously essential in the control of traffic. It was not only early recognized that rigid, unyielding structures constituted of metal or wood caused bodily injuries and death when struck by vehicles; but also caused physical damage to the vehicles, and consequent damage to the structures themselves which generally had to be replaced. Traffic guides, directors and barriers which yielded on impact of a moving vehicle therewith were thus designed and used at an early date. The earliest structures of this type appear to have been rubber signs which yielded on contact with moving vehicles, and then re-erected themselves by rebounding after passage of the vehicles thereover. A patent, perhaps the first, but certainly one of many covering a structure of this type is one issued in 1926, to wit: U.S. Pat. No. 1,581,809. Whereas this type of structure enjoyed limited success as a means of conveying useful information to drivers, it was of little value for use as a traffic guide post, or barrier, in the demarcation of danger areas, traffic zones, or lanes. The use of solid, rigid unyieldable metal or wooden posts as guide posts and barriers continued; as did the injuries, deaths and property damage.

The problems caused by use of the rigid guide posts, or pickets however did not go unrecognized. Various types of posts were designed and used in efforts to lessen injuries, deaths and property damage caused by vehicular impacts. In some early designs the posts were made with an upper break-away section, the base being partially covered by the soil and projecting insufficiently high above the ground for impact with the vehicle; the upper break-away section being easily detached on impact. (See, e.g., U.S. Pat. No. 2,121,961) A patent covering what may have been the first flexible, rebound type post was issued in 1933 as U.S. Pat. No. 1,939,968. The structure covered by this patent was one wherein an inner coil spring was covered by a resilient tubular casing, and the lower portion thereof was anchored to a low concrete base via a cable. On impact with a vehicle the post would bend, and its position was thereafter self-restored on passage of the vehicle thereover.

Various other patents can be cited as representative of the present state-of-the-art, relating to guide posts, and pickets; to wit:

U.S. Pat. No. 3,091,997 relates to a highway marker having an upper ribbed resilient, or bendable portion, suitably of rubber, with a special removable type base.

U.S. Pat. No. 3,371,647 relates to a flexible post the upper portion of which is constituted of foam rubber, with a vinyl coating. The upper portion fits into a socket base which is buried in the ground. The post appears a hybrid between the flexible and break-away types.

U.S. Pat. No. 3,478,715 is constituted of an upper portion flexible by virtue of a rubber staff support which attaches an upper rigid member to a base.

U.S. Pat. No. 3,502,007 is comprised of a road marker constituted of a hollow, flexible plastic member which rebounds on impact. The upper portion of the post is relatively thin, and it is secured to a relatively thick shaft with a concealed lower end having anchoring protrusions.

U.S. Pat. No. 3,875,720 is comprised of a post made resilient or flexible by virtue of a section constructed of a bundle of parallelly aligned rods secured loosely together to hold an upper rigid member in place to a base member. Impact of an object upon the post causes slippage, and yielding of the bundle of rods so that the post flexes, or bends, without rebounding.

U.S. Pat. No. 3,709,112 relates to a post constituted of an elastic, polyethylene hollow body member triangular in cross-section throughout its length, with all of its exterior corners rounded so that the body can bend and substantially flatten out without breaking on vehicular impact; and then rebound after passage of the vehicle.

Whereas many such guide posts, and pickets, have enjoyed limited success, there is yet considerable need for improvements due, inter alia, to the nature of the material of which the posts, and pickets, are constructed, or the nature of the construction itself. Two of the major problems of various of the posts, and pickets, is deterioration due to sunlight and embrittlement at low, freezing or subzero temperatures, this causing the posts to loose their original physical properties so that they easily break, or tear apart on impact. This is true, for example, of the polyethylene post, or picket, characterized in U.S. Pat. No. 3,709,112 supra. Another problem of major significance relates to the need for lodging, securing, or attaching the base of a post within the soil. Many posts cannot be driven into the soil, and they can be attached to the soil only after digging holes for burying the bases thereof which are then covered by the soil. This technique is obviously time consuming and extremely expensive. Certain of these structures are simply too complex and expensive to manufacture and use in the quantities required for modern highway and road use. Others cannot be adequately marked, or painted, with the required facility to attract drivers attention when used to mark intersections, repair section or other hazardous locations.

A primary objective of the present invention is to obviate these and other prior art problems and, in particular, provide a new and novel highway post delineator, or picket, of the rebounding type of relatively simple construction which can be easily manufactured in various combinations of highway safety colors, e.g., white, or other light or luminous colors; and they can be driven vertically into the soil, and thereby mounted for operative use.

A specific object is to provide a post, or picket, of such character which can be manufactured in quantity by a simple extrusion technique, the exterior simultaneously containing luminous highway safety colors, and such post, or picket, is capable of remaining highly flexible, bent in any direction, and reboundable on impact, even at freezing, or sub-freezing conditions.

These objects and others are achieved in accordance with the present invention which is characterized generally as a post, or picket, constituted of a resilient, flexible elongate tubular body of thermoplastic rubber, the cross-section of which is trapezoidal throughout its length, especially one which can be fitted with a foot member for mounting and affixing said post within the soil adjacent or within a highway or roadbed.

The thermoplastic rubber employed for the construction of the resilient, flexible elongate tubular body is a polyolefin based polymer composition which, prior to curing, can be extruded at high production rates and which, after curing, provides low temperature flexibility, high temperature deformation and aging resistance, long term weathering resistance, and good chemical and ozone resistance. A preferred class of thermoplastic rubber is that produced by UNIROYAL CHEMICAL, a division of UNIROYAL, Inc. of Naugatuck, Conn., characterized as TPR 5100 series and described in UNIROYAL, Inc.'s U.S. Pat. Nos. 3,806,558 and 4,031,169 by William K. Fischer and Harris L. Morris, respectively; both of which are herewith incorporated by reference.

In accordance with processes described by these patents, a thermoplastic elastomeric blend of monoolefin copolymers with polyolefins is partially cured while in admixture with a resin, and then fabricated into shaped articles, without necessity of vulcanization, by such methods as molding and extrusion. Thus, a blend of monoolefin copolymer rubber, typified by saturated EPM (ethylenepropylene copolymer rubber) or unsaturated EPDM (ethyl-propylene-non-conjugated diene terpolymer rubber), with a polyolefin resin, typified by polyethylene or polypropylene, is partially cured by the action of a conventional curing agent while masticating the mixture. During curing, the blend is only partially cross-linked, i.e. it is only partially cured, and therefore not cross-linked to the state where it becomes entirely soluble in the usual solvents for the uncured blend. A preferred themoplastic rubber for use in this invention is that characterized in UNIROYAL's 4,031,169 patent as one constituted from a blend of (A) 30 to 90 parts by weight of a terpolymer rubber of (i) ethylene, (ii) an alpha monoolefin having the structure $CH_2=CH\text{-}R$ wherein R is an alkyl radical having 1 to 12 carbon atoms, the ratio of the ethylene to alpha-monoolefin being 70/30 to 85/15 by weight, and (iii) dicyclopentadiene, and (B) correspondingly 70 to 10 parts by weight of a polyolefin resin, the said terpolymer (A) having a zero shear viscosity not greater than $0.5\times10^9$ poises at 135° C., and the said blend is one having an ultimate tensile strength of at least 1000 psi, and elongation at break of at least 100%, and an elongation set at break not greater than 50%.

An especially preferred series of thermoplastic rubber (TPR) made pursuant to the teachings of these patents are those characterized as UNIROYAL's 5160, 5180 and 5190 series; particularly the latter, the typical unaged extruded physical characteristics of which are identified in the following table, to wit:

TABLE

| TYPICAL UNAGED EXTRUDED PHYSICALS, TPR | 5160 | 5180 | 5190 |
|---|---|---|---|
| Specific Gravity | .88 | .88 | .88 |
| Durometer Shore A | 67 | 88 | 92 |
| Tensile Test (ASTM D-412) psi Modulus @ 200 elongation | 150 | 650 | 950 |
| Ultimate Tensile psi | 450 | 900 | 1250 |
| Ultimate Elongation, % | 600 | 600 | 400 |
| Elongation Set, % | 20 | 30 | 50 |
| Tear (ASTM D-470) PLI | 40 | 100 | 100 |
| Ross Flex (ASTM D-1052) kc to 100% growth | 35 | 250 | 0.2 |
| NBS Abrasion Index (ASTM D 1630) | 30 | 60 | 100 |
| Brittle Point (ASTM D-746)°F. | <−100 | <−100 | <−100 |
| Mandrel Bend °F. | <−65 | <−65 | <−64 |
| Gehman Torsional Modulus (ASTM D-1052)psi | | | |
| −100° F. | 72,000 | 150,000 | 180,000 |
| −50° F. | 1,400 | 65,000 | 120,000 |
| −0° F. | 600 | 50,000 | 100,000 |
| +50° F. | 380 | 35,000 | 50,000 |
| +100° F. | 270 | 16,000 | 36,000 |
| +150° F. | 200 | 8,000 | 13,000 |
| +200° F. | 160 | 6,000 | 10,000 |
| +250° F. | 130 | 5,000 | 6,000 |
| +300° F. | 80 | 3,500 | 4,000 |

The foot member is constituted of a rigid material provided with an upper portion of cross-section corresponding substantially with that of said resilient, flexible thermoplastic rubber body and, as such, adaptable for receiving the lower portion of said post which can be fitted snugly therein, and retained. The lower portion of the foot member is provided with vertically downwardly projecting serrated edges, the lower ends of which are beveled, tapered, and sharp, for cutting into the soil within which the post is to be errected. In a preferred technique for securing the post within the soil, the lower end of the resilient, flexible thermoplastic rubber body is fitted snugly into the upper portion of the foot member and retained therein, the post is vertically positioned with the lower end of the foot member resting upon the soil surface, a rod or bar is extended through the interior of said thermoplastic rubber body into contact with the inside, lower face of the foot member, force is exerted on the rod, or bar, and the foot member with the lower end of the thermoplastic rubber body is thereby driven into the soil, and the rod or bar is then withdrawn to leave the post vertically standing within the soil.

These and other features and advantages will be better understood by reference to the following detailed description and to the accompanying drawings to which reference is made in the description. In the drawings, similar numbers are used to represent similar parts or components in the different figures, or views, and subscripts are used to designate a plurality of similar or analogous parts. Where a part is referred to using only the whole number where there are a number of similar or analogous components, the use of the number is intended in a generic sense.

Referring to the drawings

Figure 3:
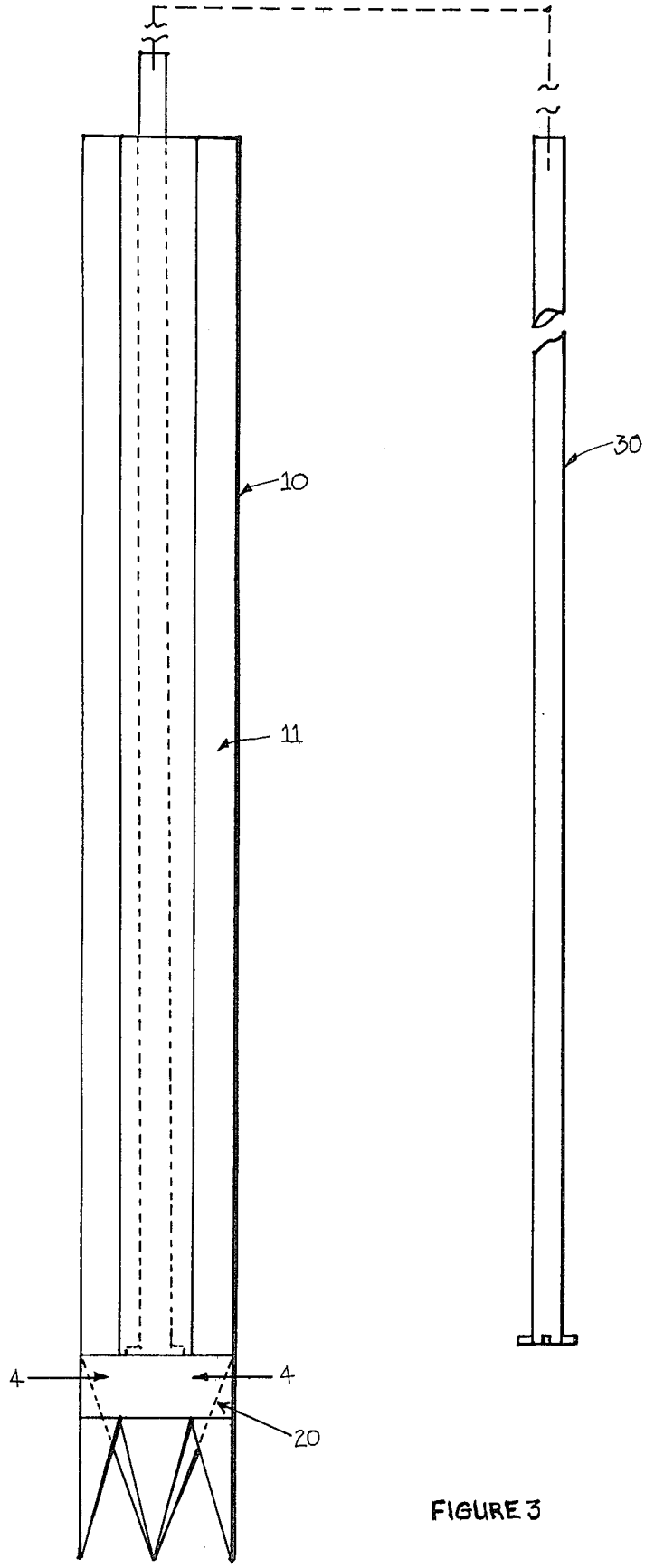
Figure 4A:
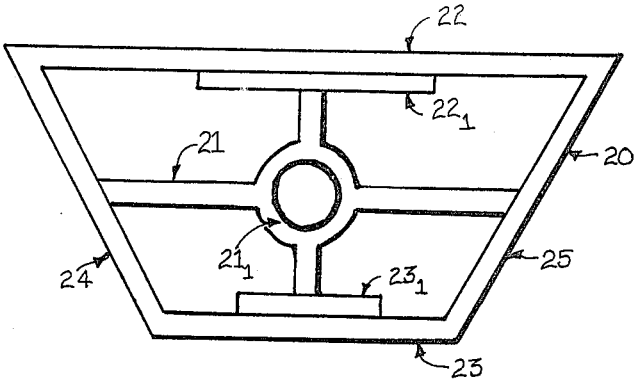
Figure 4B:
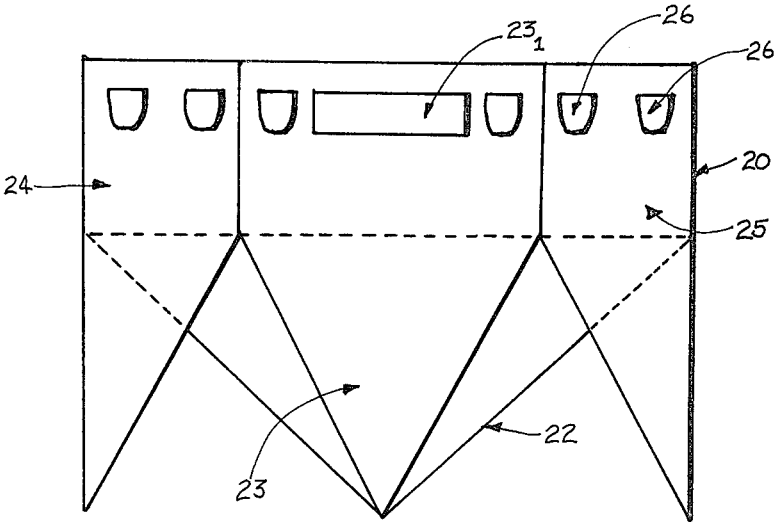
Figure 4C:
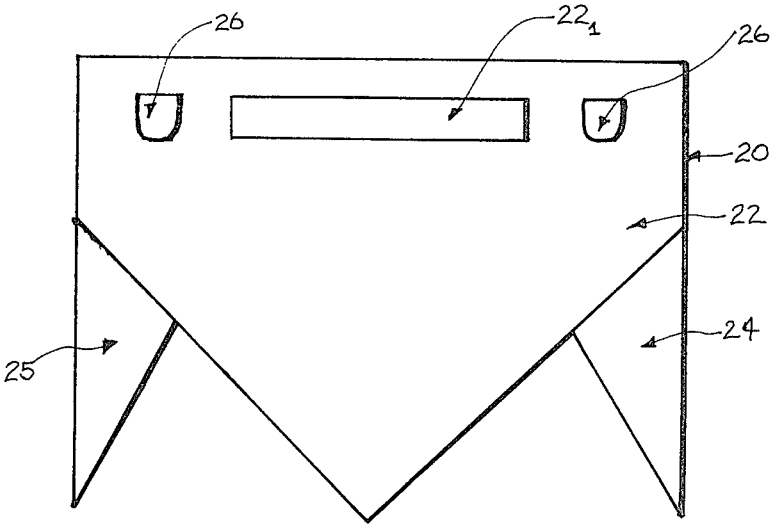

FIG. 3 depicts a front elevation of a preferred post, inclusive of the tubular body and foot portion within which said body can be fitted for mounting within the soil, as that of a roadbed or highway; and FIG. 4 depicts a series of views of the foot member; a first view, FIG. 4A, being one taken along the line 4—4 of FIG. 3; a second view, FIG. 4B, being a front view; and a third view, FIG. 4C, being a rear view of the foot member of FIG. 3.

Figure 1:
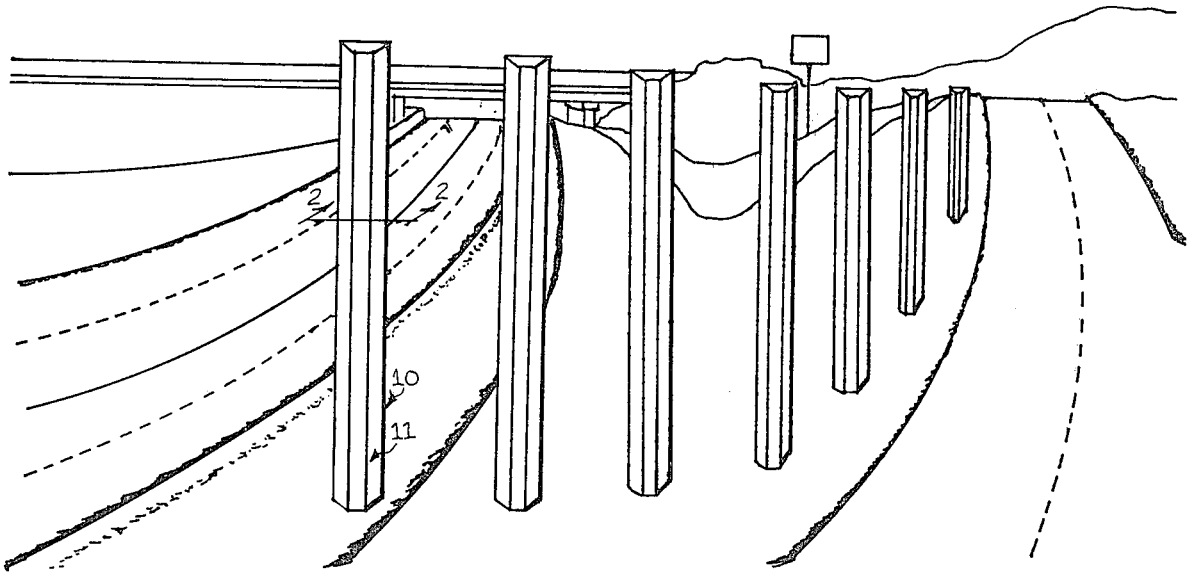
FIG. 1 depicts a series of the preferred posts of this invention as mounted to mark a highway entrance or exit ramp, narrow median, gore point or traffic island.
Figure 2:
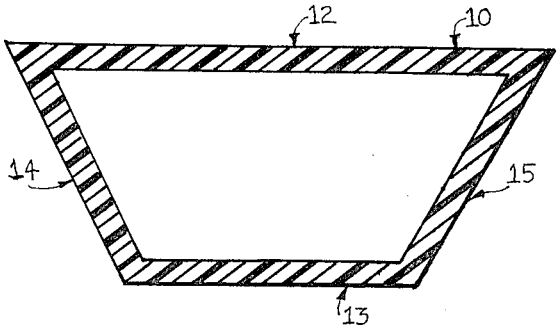
FIG. 2 depicts a cross-section taken through section 2—2 of the body of the post depicted in the preceeding figure.

Referring to FIG. 1, a series of the identical posts 10 of this invention are shown mounted within the soil of a roadbed or highway, a major portion of the flexible, tubular thermoplastic rubber body portions 11 of which are vertically projected above the surface of the soil, while the lower portions thereof, inclusive of the foot members 20 (FIGS. 3–4), are located beneath the surface of the soil. The thermoplastic rubber body is hollow, and of trapezoidal cross-section; or cross-section which provides two parallel sides and two non-parallel sides.

In the preferred form one of the parallel sides 12 constituting the trapezoid is somewhat longer than the other sides 13, 14, 15, the longest side 12 constituting the back or rear wall of the tubular thermoplastic rubber body while the parallel side opposite thereto, i.e. side 13, constitutes the front wall of said body. The front wall 13 is of lesser length than the rear wall 12, and the non-parallel side walls 14, 15 the edges of which are adjoined to the edge of parallel walls 12, 13, approximate or are of slightly greater length than wall 13. Preferably, the walls 14, 15 are of equal length; the wall 13 is centered in front of rear wall 12 so that the angles between walls 12, 15 and 12, 14 are equal and less than 90°, and the angles between walls 13, 15 and 13, 14 are equal and greater than 90°. Suitably, for example, the back wall 12 is twice the length of the front parallel wall 13, and the non-parallel walls 14, 15 range from about equal to about 25 percent, preferably from about 10 percent to about 15 percent, longer than front wall 13. Reflecting materials of various colors can be placed on the exterior surfaces of wall 13, 14, 15 and these sides conveniently directed toward oncoming traffic. The two non-parallel walls 14, 15 can be marked with different colors, e.g. white or yellow, this permitting the use of a single post to mark a division in a road since both walls, and front wall 13, can be seen by approaching traffic. Suitably also, the back wall 12 can be marked with a color, e.g. a reflective red surface to indicate that traffic approaching from a direction where this color is visible is proceeding in the wrong direction. The posts 10 can be readily extruded in any wall thickness desired; the wall thickness of a post generally ranging from about 0.05 inch to about 0.2 inch, preferably from about 0.06 inch to about 0.15 inch; and luminous colors or dies can be conveniently added to the exterior surface of any of walls 12, 13, 14, 15 by co-extrusion or painting while the posts are being extruded.

In installing, or mounting a post 10 in the earth the lower portion thereof is fitted into a foot member 20, a rod 30 as shown by reference to FIG. 3 is passed through the open interior of the body of a post 20 so that its lower end temporarily engages the foot member 20, force is applied on the rod 30 to cause the foot member to cut into the earth and thereby bury the foot member 20 and lower portion of a post 10 in the earth, and immediately thereafter the rod 30 can be withdrawn. Suitably, the rod 30 is vibrated with a machine tool to apply the needed force, or driven with a sledge hammer.

The foot member 20 is constituted of a rigid material, suitably of metal or a rigid plastic, the former being preferred due to its higher rigidity. Exemplary of such materials are ferrous metals, e.g., iron or iron alloys, particularly steel, and such plastics as glass reinforced polyester, urea-formaldehyde resins and the like. The upper portion of foot member 20 is of shape corresponding to the cross-section of the post 10, and its inside surface is adapted for receipt of the lower end of post 10 which can be snugly fitted therein and retained, as by use of a pin, or pins. Thus, the walls 22, 23 of the foot member 20 correspond generally with walls 12, 13 of the body 11 of the post, and walls 24, 25 correspond generally with walls 14, 15. However, the parallelogram formed by the outside faces of the walls of the body 11 of the post conforms substantially in size with the parallelogram formed by the inside faces of the walls of foot member 20 to form a mouth portion within which the post can be fitted. Alternately disposed tabs $22_1$, $23_1$, formed from a section of walls 22, 23 of foot member 20 provide a surface upon which the bottom face of the body 11 of the post can be rested. The upper mouth portion of the foot member 20, below the tabs $22_1$, $23_2$, is also provided with a web 21, which serves as a driving frame, which can be spot welded in place. In such function, the rod 30 can be rested against the center $21_1$ thereof, and forced can be exerted thereupon to drive said foot member 20 into the soil. The lowermost ends of each of the walls 22, 23, 24, 25 of the foot member 20 are tapered, or beveled, and sharpened to provide a relatively sharp leading edge to facilitate driving said member into the soil.

This feature of the foot member 20 is best shown by specific reference to FIGS. 4B and 4C. Thus, in these views it will be observed that the lower end of each wall 22, 23, 24, 25 of the foot member are beveled to a point, the sections being joined together to form in effect a continuous, closed array of downwardly projected, vertically oriented sharpened serrations, which in effect forms teeth. The foot member 20, it will also be observed, is provided with a series of alternately disposed punch out sections 26 which, when not completely removed, could be impinged against the wall 11 of a post to permanently retain same in place within a foot member 20. Or alternatively, pins can be passed through pairs of the openings 26 to retain or pin the post to the foot member. By virtue of this arrangement therefore, the post with its foot member can be unitized and driven into the soil, the stability of the post and its position within the soil being assured by such combination.

The thermoplastic rubber of which the tubular body of a post 10 is constructed provides tremendous elasticity which, with the trapezoidal shape, enhances the rebound properties of the post. Unlike previous posts of triangular cross-section which were constructed of polyethylene, the post does not tear, or tend to tear at the junctures where the sides are joined. A post 10, because it can be oriented to provide two parallel sides substantially perpendicular to the direction of the applied force can flex with very little mechanical interference, this considerably reducing any chance of failure. Moreover, the post can readily rebound when the distorting force is removed due to its inherent superior elastic properties.

It is apparent that various modifications and changes, such as in the absolute and relative dimensions of the component parts, and to some degree in the materials of construction without departing the spirit and scope of the invention as will apparent to those skilled in the art.

The body of the post is necessarily constructed of thermoplastic rubber, hollow, and of trapezoidal cross-section throughout its length. The trapezoidal cross-section is necessary to impart the required rigidity to permit the thermoplastic rubber body to be selfsupporting and reboundable. This shape reduces the mechanical interferences to flexibility in the direction of the applied force while still retaining the self righting feature.

The foot member is necessarily constructed of a rigid material, its upper portion is open and of cross-section corresponding to that of the post body so that the latter can be fitted thereupon, and the lower portion thereof is tapered. The foot member can be constructed in whole or in part of rigid plastic, or metal.

Having described the invention what is claimed is:

1. Apparatus characterized as a post which can be vertically positioned within the soil for delineation of a section of highway which, on vehicular impact is capable of flexing in any direction, and then rebounding to its original position which comprises:

a resilient, flexible tubular body of trapezoidal cross-section throughout its length, the four walls which adjoin to form the trapezoidal cross-section including parallel walls and adjoining non-parallel walls, one of the parallel walls forming the trapezoidal cross-section being of greater length than the other walls, and said tubular body is constructed of thermoplastic rubber characterized as an elastomeric blend of mono-olefin polymers with polyolefins which is partially cured while in admixture with a resin.

2. The apparatus of claim 1 wherein the resilient, flexible tubular thermoplastic rubber body is comprised of a blend of mono-olefin copolymers rubber and a polyolefin resin partially cured by the action of a conventional curing agent while masticating the admixture.

3. The apparatus of claim 2 wherein the thermoplastic rubber post possesses the following physical characteristics, to wit:

| | |
|---|---|
| Specific Gravity | .88 |
| Durometer Shore A | 92 |
| Tensile Test (ASTM D-412) psi Modulus @ 200 elongation | 950 |
| Ultimate Tensile psi | 1,250 |
| Ultimate Elongation, % | 400 |
| Elongation Set, % | 50 |
| Tear (ASTM D-470) PLI | 100 |
| Ross Flex (ASTM D-1052) kc to 100% growth | 0.2 |
| NBS Abrasion Index (ASTM D 1630) | 100 |
| Brittle Point (ASTM 3-746) °F. | <−100 |
| Mandrel Bend °F. | <−65 |
| Gehman Torisonal Modulus (ASTM D-1053) psi | |
| −100° F. | 180,000 |
| −50° F. | 120,000 |
| −0° F. | 100,000 |
| +50° F. | 50,000 |
| +100° F. | 36,000 |
| +150° F. | 13,000 |
| +200° F. | 10,000 |
| +250° F. | 6,000 |
| +300° F. | 4,000 |

4. The apparatus of claim 1 where the non-parallel walls are of substantially equal length, the angles formed between the non-parallel walls at the locations where they are adjoined to the long parallel wall are less than 90°, while the angles formed between the non-parallel walls at the locations where they are adjoined to the short parallel wall are greater than 90°.

5. The apparatus of claim 4 wherein the shorter of the parallel walls is centered upon the longer wall.

6. In combination, apparatus characterized as a post to the lower portion of which is fitted a complimentary foot member for attaching and vertically positioning the post, via use of a rigid elongated member, within the soil for delineation of a section of highway, is capable of flexing in any direction, and then rebounding to substantially its original position which comprises:

a resilient, flexible tubular body of trapezoidal cross-section throughout its length, the four walls which adjoin to form the trapezoidal cross-section including parallel walls and adjoining non-parallel walls, one of the parallel walls forming the trapezoidal cross-section being of greater length than the other walls, and said tubular body is constituted of thermoplastic rubber characterized as an elastomeric blend of mono-olefin polymers with polyolefins which is partially cured while in admixture with a resin, and a foot member of rigid material provided with an upper portion of cross-section corresponding substantially with, and to which said resilient, flexible thermoplastic rubber body is fitted, and retained, and a lower portion which is provided with vertically downwardly projection serrated edges, the edges being beveled, tapered and sharp for cutting into said soil within which said post is to be erected, whereby said rigid elongated member can be passed through said resilient, flexible tubular thermoplastic rubber body for contact with said foot member, force being exerted on said elongate member to drive said foot member into the soil, and the elongated member thereafter withdrawn to leave the post in erected position.

7. The apparatus of claim 6 wherein the resilient, flexible tubular thermoplastic rubber body of the post is constituted of a blend of mono-olefin copolymer rubber and a polyolefins resin partially cured by the action of a conventional curing agent while masticating the admixture.

8. The apparatus of claim 7 wherein the thermoplastic rubber body of the post posseses the following physical characteristics, to wit:

| | |
|---|---|
| Specific Gravity | .88 |
| Durometer Shore A | 92 |
| Tensile Test (ASTM D-412) psi Modulus @ 200 elongation | 950 |
| Ultimate Tensile psi | 1,250 |
| Ultimate Elongation, % | 400 |

-continued

| | |
|---|---|
| Elongation Set, % | 50 |
| Tear (ASTM D-470) PLI | 100 |
| Ross Flex (ASTM D-1052) kc to 100% growth | 0.2 |
| NBS Abrasion Index (ASTM D 1630) | 100 |
| Brittle Point (ASTM 3-746) °F. | <−100 |
| Mendrel Bend °F. | <−65 |
| Gehman Torisonal Modulus (ASTM D-1053) psi | |
| −100° F. | 180,000 |
| −50° F. | 120,000 |
| −0° F. | 100,000 |
| +50° F. | 50,000 |
| +100° F. | 36,000 |
| +150° F. | 13,000 |
| +200° F. | 10,000 |
| +250° F. | 6,000 |

-continued

| | |
|---|---|
| +300° F. | 4,000 |

9. The apparatus of claim 6 wherein the cross-section of resilient, flexible tubular thermoplastic rubber body of the post includes non-parallel walls are of substantially equal length, the angles formed between the non-parallel walls at the locations where they are adjoined to the long parallel wall are less than 90°, while the angles formed between the non-parallel walls at the locations where they are adjoined to the short parallel wall are greater than 90°.

10. The apparatus of claim 9 wherein the shorter of the parallel walls of the post is centered upon the longer wall.

* * * * *